US005401708A

United States Patent [19]

Shimizu et al.

[11] Patent Number: 5,401,708

[45] Date of Patent: Mar. 28, 1995

[54] HEAT-SENSITIVE RECORDING MATERIAL

[75] Inventors: Yoshihiro Shimizu, Nishinomiya; Takuji Tuji; Ritsuo Mandoh, both of Sakai; Hisayoshi Mitoh, Nagaokakyo, all of Japan

[73] Assignee: Kanzaki Paper Mfg. Co., Ltd., Tokyo, Japan

[21] Appl. No.: 63,025

[22] Filed: May 17, 1993

[30] Foreign Application Priority Data

May 19, 1992 [JP] Japan ..... 4-125254
Aug. 26, 1992 [JP] Japan ..... 4-226765

[51] Int. Cl.[6] ..... B41M 5/30; B41M 5/40

[52] U.S. Cl. ..... 503/226; 503/200; 503/214

[58] Field of Search ..... 427/152; 503/200, 214, 503/226

[56] References Cited

U.S. PATENT DOCUMENTS 5,236,883 8/1993 Nakazawa et al. ..... 503/200

*Primary Examiner*—B. Hamilton Hess
*Attorney, Agent, or Firm*—Morgan & Finnegan

[57] ABSTRACT

In the heat-sensitive recording material which has on a base sheet a heat-sensitive recording layer containing a colorless or pale colored chromogenic material and a color developer forming a color by reacting with the chromogenic material and a protective layer arbitrarily formed on the recording layer, a water-soluble graft copolymer of a polymer comprising at least one ethylenically unsaturated carboxylic acid unit and silicone is comprised in the recording layer and/or the protective layer.

10 Claims, No Drawings

HEAT-SENSITIVE RECORDING MATERIAL

BACKGROUND OF THE INVENTION

This invention relates to a heat-sensitive recording material which is superior in each of water resistance, printability and recording runnability.

There has been known heat-sensitive recording materials utilizing the color forming reaction between a color former and a color developer, in which the two color forming materials are thermally contacted each other to produce recorded images. These heat-sensitive recording materials are comparatively inexpensive and can be used on a recording equipment which is compact and requires fairly easy maintenance. Because of these advantages, the heat-sensitive recording materials have been used not only as the recording medium of facsimiles and various computers, but also in the other various fields.

As the applications, recording medium for a portable printer, a label or tag printer becomes noticeable accompanied with increased point-of-sales systemalization of retail stores. The handy terminal or the like is often used out of doors. It is a problem that the recording layer easily peels by wetting with rain. Further, since an offset printing must be applied on the recording surface in such an application, a heat-sensitive recording material superior in the printability has been required.

In order to improve the water resistance of a heat-sensitive recording layer, there have been known adding water-proof agents in the heat-sensitive recording layer as shown in Japanese Laid-Open Patent Publications No.36343 of 1962 and No. 33352 of 1969 and using a hydrophobic polymer emulsion as a binder in the heat-sensitive recording layer as shown in Japanese Laid-Open Patent Publications No. 14998 of 1972, No. 18520 of 1972 and No. 8084 of 1990. However, a heat-sensitive recording layer superior in each of water resistance, printability and recording runnability has not been practically obtained.

Further, it has been known to form on the heat-sensitive recording layer a protective layer comprising a water-soluble polymer to dissolve such a problem that recorded images disappear by contacting with an oily finger, handcream, plasticizer comprised in vinyl chloride resins or the like. Although the formation of protective layer effectively prevents sticking, smudges adhered on a thermal head, contamination by rubbing and the like, a heat-sensitive recording material superior in water-resistance and printability can not be obtained.

Therefore, an object of the invention is to dissolve the above problems to provide a heat-sensitive recording material superior in water-resistance and printability and also recording runnability.

SUMMARY OF THE INVENTION

The heat-sensitive recording material according to the invention has on a base sheet a heat-sensitive recording layer containing a colorless or pale colored chromogenic material and a color developer which forms a color by reacting with the chromogenic material, and a protective layer formed on the recording layer. A water-soluble graft copolymer of a polymer comprising at least one ethylenically unsaturated carboxylic acid unit and silicone is comprised in the recording layer and/or the protective layer.

DETAILED DESCRIPTION OF THE INVENTION

In the heat-sensitive recording material of the first embodiment of the invention, a water-soluble graft copolymer of a polymer comprising at least one ethylenically unsaturated carboxylic acid unit and silicone is comprised in the recording layer formed on a base sheet.

In the heat-sensitive recording material of the second embodiment of the invention, a protective layer is formed on the recording layer and a water-soluble graft copolymer of a polymer comprising at least one ethylenically unsaturated carboxylic acid unit and silicone is comprised in the protective layer.

In the above two embodiments, the top layer can be formed to not substantially peel off even if it be wetted, by adding to the top layer a specific water-soluble graft copolymer. The top layer is stably maintained during printing. These heat-sensitive recording materials are superior in recording runnability and can develop color images without a sticking phenomenon between the surface of them and thermal head of a recording device. The sticking phenomenon during the recording process results in shortening the recording and generating a white line (unrecorded area) in the recorded images.

In the heat-sensitive recording material of the third embodiment of the invention, a water-soluble graft copolymer of a polymer comprising at least one ethylenically unsaturated carboxylic acid unit and silicone is comprised in both of the recording layer and the protective layer.

In the above heat-sensitive recording material, there can be obtained not only improved water resistance and printability but also improved image-retainability, namely superior chemical resistance of recorded images such as oily resistance and plasticizer resistance, and preventive effects of sticking, smudges adhered on thermal head and contamination by rubbing, because of the presence of protective layer. Particularly, by adding a specific water-soluble graft copolymer to both of the recording layer and the protective layer, can be obtained very stable heat-sensitive recording material in which each of layers does not peel off even if water permeates into the recording layer.

Further, as the fourth embodiment of the invention, a protective layer not containing a specific water-soluble graft copolymer may be formed on the heat-sensitive recording layer containing a specific water-soluble graft copolymer. In this case, the effects of protective layer can be obtained but the water resistance and printability are inferior to those obtained in the third embodiment.

The present invention is characterized in comprising in the heat-sensitive recording layer- and/or the protective layer having a water-soluble graft copolymer of a polymer comprising at least one ethylenically unsaturated carboxylic acid unit with silicone. As the polymer comprising at least one ethylenically unsaturated carboxylic acid unit, there are exemplified polyacrylic acid, polymethacrylic acid, polyitaconic acid, polycrotonic acid, polyfumaric acid, polymaleic acid, acrylic acid-methylmethacrylate copolymer, maleic acid-styrene copolymer and the like. As the silicone, there are exemplified dimethylpolysiloxane, diethylpolysiloxane, diphenylpolysiloxane and the like.

The used amount of silicone is preferably 5 to 50% by weight, more preferably 10 to 30% by weight, based on the amount of the polymer comprising at least one ethylenically unsaturated carboxylic acid unit. When the amount of silicone becomes less than 5% by weight, the desired water resistance and printability can not be obtained, and when it becomes more than 50% by weight, the adhesion force of the copolymer becomes lower.

For example, the water-soluble graft copolymer as specified above may be produced by radically copolymerizing (1) a macro-monomer having a methacryloyl group at an end of silicone, (2) ethylenically unsaturated carboxylic acid, and (3) arbitrarily added radically polymerizable other monomer. As the above component (3), there are exemplified styrene; alkyl (meth)acrylates such as methyl methacrylate, ethyl methacrylate, ethyl acrylate, butyl acrylate and ethylhexyl methacrylate; and hydroxymethacrylate such as 2-hydroxymethacrylate; and the like.

Thus obtained graft-copolymer is neutralized by a basic material to be used in the form of a salt such as sodium, potassium or ammonium salt.

The amount of the above specified water-soluble graft copolymer added to the recording layer and/or the protective layer is not particularly limited, but it is preferably added to the recording layer in an amount of 1 to 15% by weight based on the total solid amount of the recording layer. when the added amount is too small, it is difficult to substantially improve water-resistance. On the other hand, when it is too large, the recording sensitivity and the color density of recorded images become lower. Further, in the protective layer, it is preferably added to 0.1 to 50% by weight based on the total solid amount of the protective layer. When the amount is lower than 0.1% by weight, it is difficult to substantially improve the water resistance and printability, and when it is more than 50% by weight, the applicability for writing and printing is lowered.

Particularly, by adding the specific water-soluble graft copolymer to both of the recording layer and the protective layer, each of water resistance and printability is very remarkably improved.

A binder other than the above specific water-soluble graft copolymer may be included in the recording layer and the protective layer. As the binders, there are exemplified water-soluble polymers such as starches, e.g., oxidized starch, enzyme-modified starch, cation-modified starch, esterified starch and etherified starch; cellulose derivatives, e.g., methyl cellulose, ethyl cellulose, carboxymethyl cellulose, methoxy cellulose and hydroxyethyl cellulose; polyvinyl alcohols, e.g., completely or partially saponified polyvinyl alcohol, carboxy-modified polyvinyl alcohol, silicon-modified polyvinyl alcohol and acetoacetyl-modified polyvinyl alcohol; sodium salt of polyacrylic acid; polyacrylamide; polyvinylpyrrolidone; acrylic acid amide-acrylic ester copolymer; acrylic acid amide-acrylic ester-methacrylic acid copolymer; alkali salt of styrene-maleic anhydride copolymer; alkali salt of styrene-acrylic acid copolymer; alkali salt of ethylene-acrylic acid copolymer; alkali salt of isobutylene-maleic anhydride copolymer; sodium alginate; gelatin; casein; gum arabic; urea resins and melamine resin; and latexes such as polyvinylacetate latex, polyurethane latex, polyacrylic acid latex, polyacrylic ester latex, polybutylmethacrylate latex, styrene-butadiene copolymer latex, vinyl chloride-vinyl acetate copolymer latex, etylene-vinyl acetate copolymer latex and styrene-butadiene-acrylate latex; and the like. In the protective layer, at least one selected from the group consisting of carboxy-modified polyvinyl alcohol, silicon-modified polyvinyl alcohol and acetoacetyl-modified polyvinyl alcohol is preferably included. Particularly, acetoacetyl-modified polyvinyl alcohol is preferably used, because a strong film can be formed by using it together with a water-proofing agent such as glyoxal.

As the basic chromogenic materials comprised in the heat-sensitive recording layer, there may be used various known colorless or pale-colored basic chromogenic materials, such as triarylmethane compounds, e.g., 3,3-bis(p-dimethylaminophenyl)-6-dimethylaminophthalide, 3,3-bis(p-dimethylaminophenyl)phthalide, 3-(p-dimethylaminophenyl)-3-(1,2-dimethylindole-3-yl)phthalide, 3-(p-dimethylaminophenyl)-3-(2-methylindole-3-yl) phthalide, 3,3-bis(1,2-dimethylindole-3-yl)-5-dimethylaminophthalide, 3,3-bis(1,2-dimethylindole-3-yl)-6-dimethylaminophthalide, 3,3-bis(9-ethylcarbazole-3-yl)-6-dimethylaminophthalide, 3,3-bis(2-phenylindole-3-yl)-6-dimethylaminophthalide and 3-p-dimethylaminophenyl-3-(1-methylpyrrole-3-yl)-6-dimethylaminophthalide; diphenylmethane compounds, e.g., 4,4'-bis-dimethylaminobenzhydryl benzyl ether, N-halophenyl-leucoauramine and N-2,4,5-trichlorophenyl-leucoauramine; thiazine compounds, e.g., benzoyl-leucomethylene blue and p-nitrobenzoyl-leucomethylene blue; spiro comounds, e.g., 3-methyl-spiro-dinaphthopyran, 3-ethyl-spirodinaphthopyran, 3-phenyl-spirodinaphthopyran, 3-benzyl-spirodinaphthopyran, 3-methyl-naphtho(6'-methoxybenzo)spiropyran and 3-propyl-spiro-dibenzopyran; lactam compounds, e.g., Rhodamine 3-anilinolactam, rhodamine(p-nitroanilino)-lactam and rhodamine(o-chloro-anilino)-lactam; fluoran compounds, e.g., 3-dimethylamino-7-methoxyfluoran, 3-diethylamino-6-methoxyfluoran, 3-diethylamino-7-methoxyfluoran, 3-diethylamino-7-chlorofluoran, 3-diethylamino-6-methyl-7-chlorofluoran, 3-diethylamino-6,7-dimethylfluoran, 3-(N-ethyl-p-toluidino)-7-methylfluoran, 3-diethylamino-7-(N-acetyl-N-methylamino)-fluoran, 3-diethylamino-7-N-methylaminofluoran, 3-diethylamino-7-dibenzylaminofluoran, 3-diethylamino-7-(N-methyl-N-benzylamino)fluoran, 3-diethylamino-7-(N-chloroethyl-N-methylamino)foulan, 3-diethylamino-7-diethylaminofluoran, 3-(N-ethyl-p-toluidino)-6'-methyl-7-phenyl-aminofluoran, 3-(N-cyclopentyl-N-ethylamino)-6-methyl-7-anilinofluoran, 3-(N-ethyl-p-toluidino)-6-methyl-7-(p-toluidino)fluoran, 3-diethylamino-6-methyl-7-phenylaminofluoran, 3-di(n-butyl)amino-6-methyl-7-phenylaminofluoran, 3-di(n-penyl)amino-6-methyl-7-phenylaminofluoran, 3-dietnylamino-7-(2-carbomethoxyphenylamino)fluoran, 3-(N-ethyl-N-isoamylamino)-6-methyl-7-phenylaminofluoran, 3-(N-ethyl-N-isoamylamino)-6-methyl-7-phenylaminofluoran, 3-(N-cyclohexyl-N-methylamino)-6-methyl-7-phenylaminofluoran, 3-pyrrolidino-6-methyl-7-phenylaminofluoran, 3-piperidino-6-methyl-7-phenylaminofluoran, 3-diethylamino-6-methyl-7-xylidinofluoran, 3-diethylamino-7-(o-chlorophenylamino)fluoran, 3-dibutyl-7-(o-chlorophenylamino)fluoran, 3-pyrrolidino-6-methyl-7-p-butylphenylaminofluoran, 3-(N-methyl-N-tetrahydrofurfurylamino)-6-methyl-7-anilinofluoran and 3-(N-ethyl-N-tetrahydrofurfurylamino)-6-methyl-7-anilinofluoran; and the like.

As the acidic substance comprised in the heat-sensitive recording layer together with the basic chromogenic material, there may be used various known inorganic or organic acidic substances as a color developer which develops a color upon contact with the colorless or pale-colored basic chromogenic material. There are included inorganic acidic substances such as activated clay, acid clay, attapulgite, bentonite, colloidal silica and aluminum silicate, and organic acidic substances such as 4-hydroxydiphenoxide; α-naphthol; β-naphthol; phenolic compounds, e.g., 4-hydroxyacetophenol, 4-tert-butylphenol, hydroquinone, 4-tert-octylcatechol, 4,4'-isopropylidenediphenol (Bisphenol A), 4,4'-cyclohexylidenediphenyl, 2,2'-dihydroxydiphenol, 2,2'-methylenebis(4-methyl-6-tert-butylphenol), 4,4'-isopropylidenebis(2-tert-butylphenyl), 4,4'-sec-butylidenediphenyl, 4-phenylphenol, 2,2'-methylenbis(4-chlorophenol), 4,4'-dihydroxydiphenylsulfone, 2,4'-dihydroxydiphenylsulfone, 4-hydroxy-4'-methyldiphenylsulfone, 4-hydroxy-4'-chlorodiphenylsulfone, 4-hydroxy-4'-methoxydiphenylsulfone, 4-hydroxy-4'-isopropoxydiphenylsulfone, benzyl 4-hydroxybenzoate, dimethyl 4-hydroxyphthalate, hydroxymonbenzyl ether, novolak phenol resin and phenyl polymers; aromatic carboxylic acids, e.g., benzoic acid, p-tert-butylbenzoic acid, trichlorobenzoic acid, telephthalic acid, 3-sec-butyl-4-hydroxybenzoic acid, 3-cyclohexyl-4-hydroxybenzoic acid, 3,5-dimethyl-4-hydroxybenzoic acid, salicylic acid, 3-isopropylsalicylic acid, 3-tert-butylsalicylic acid, 3-benzylsalicylic acid, 3-(α-methylbenzyl)salicylic acid, 3-chloro-5-(α-methylbenzyl)salicylic acid, 3,5-di-tert-butylsalicylic acid, 3-phenyl-5-(α,α-dimethylbenzyl)salicylic acid and 3,5-di-α-methylbenzylsalicylic acid; and salts of these phenol compounds and aromatic carboxylic acids with polyvalent metals, e.g., Zn, Mg, Al, Ca, Ti, Mn, Sn, Ni and the like.

The proportion of the chromogenic material to the color developer used in the recording layer according to the invention is not limited to any particular values and may be appropriately selected in accordance with the types of chromogenic material and color developer employed. For example, in the case of that a colorless or pale-colored chromogenic material and an acidic substance are used, generally 1 to 7 parts by weight, preferably 1 to 4 parts by weight, of the acidic substance may be used per part by weight of the basic chromogenic material.

A coating composition containing these substances may be prepared by dispersing a chromogenic material and a color developer, either as an admixture or independently, in a dispersion medium, which is typically water, by means of a suitable stirrer or grinder such as a ball mill, an attritor or a sand mill.

The coating composition may further contain various additives such as dispersing agents, e.g., sodium dioctylsulfosuccinate, sodium dodecylbenzenesulfonate, sodium lauryl sulfate and metal salts of fatty acids; waxes, e.g., zinc stearate, calcium stearate, polyethylene wax, carnauba wax, paraffin wax and ester wax; defoaming agents; fluorescent dyes; and coloring dyes.

Further, there may be added in the coating composition various pigments such as inorganic pigments, e.g., kaolin, clay, calcium carbonate, calcined clay, titanium oxide, diatomaceous earth and fine granular anhydrous silica; and organic pigments, e.g, styrene microball, Nylon powder, polyethylene powder, ureaformaldehyde resin filler, raw starch particles and polystyrene filler.

Additionally, there may be added, if necessary, to the coating composition sensitizers such as stearic acid amide, methoxycarbonyl-N-stearic acid benzamide, N-benzoylsteatic acid amide, N-eicosanic acid amide, ethylene-bis-stearic acid amide, behenic acid amide, methylene-bis-stearic acid amide, N-methylolstearic acid amide, dibenzyl telephthalate, dimethyl telephthalate, dioctyl telephthalate, benzyl p-benzyloxybenzoate, phenyl 1-hydroxy-2-naphthoate, 2-naphthyl benzyl ether, m-terphenyl, dibenzyl oxalate, di-p-methylbenzyl oxalate, di-p-chlorobenzyl oxalate, p-benzylbiphenyl, tolyl biphenyl ether, di(p-methoxyphenoxyethyl) ether, 1,2-di(3-methylphenoxy)ethane, 1,2-di(4-methytphenoxy)ethane, 1,2-di(4-methoxyphenoxy)ethane, 1,2-di(4-chlorophenoxy)ethane, 1,2-diphenoxyethan, 1-(4-methoxyphenoxy)-2-(2-methylphenoxy)ethane, p-methylthiophenyl benzyl ether, 1,4-di(phenylthio)butane, p-acetotoluidide, p-acetophenetidide, N-acetoacetyl-p-toluidine, di(β-biphenylethoxy) benzene, p-di(vinyloxyethoxy)benzene, 1-isopropylphenyl-2-phenylethane and the like.

The used amount of the sensitizer is not particularly limited, but it is preferably used in an amount of 4 parts by weight or less per part by weight of the color developer.

Further, a modifier for improving the record image-retainability may be added, if necessary, so that the desired advantages are not impaired. As the modifier, there are exemplified hindered phenol compounds such as 2,2'-methylenebis(4-methyl-6-tert-butylphenol), 2,2'-ethylenebis(4-methyl-6-tert-butylphenol), 2,2'-methylenebis(4,6-di-tert-butylphenol), 2,2'-ethylidenebis(4,6-di-tert-butylphenol), 2,2'-ethylidenebis(4-methyl-6-tertbutylphenol), 2,2'-ethylidenebis(4-ethyl-6-tert-butylphenol), 2,2'-(2,2-propylidene)bis(4,6-di-tert-butylphpenol), 2,2'-methylenebis(4-methoxy-6-tert-butylphenol), 2,2'-methylenebis(6-tert-butylphenol), 4,4'-thiobis(3-methyl-6-tert-butytphenol), 4,4'-thiobis(2-methyl-6-tert-butylphenol), 4,4'-thiobis(5-methyl-6-tertbutylphenol), 4,4'-thiobis(2-chloro-6-tert-butylphenol), 4,4'-thiobis(2-methoxy-6-tert-butylphenol), 4,4'-thiobis(2-ethyl-6-tert-butylphenol), 4,4'-butylidenebis(6-tert-butyl-m-cresol), 1[α-methyl-α-(4'-hydroxyphenyl)ethyl]-4-[α',α'-bis(4''-hydroxyphenyl)ethyl]benzene, 1,1,3-tris(2-methyl-4-hydroxy-5-cyclohexylphenyl)butane, 1,1,3-tris(2-methyl-4-hydroxy-5-tertbutylphenyl)butane, 4,4'-thiobis(3-methylphenol), 4,4'-dihydroxy-3,3', 5,5'-tetrabromodiphenylsulfone, 4,4'-dihydroxy-3,3',5,5'-tetramethyldiphenylsulfone, 2,2-bis(4-hydroxy-3,5-dibromophenyl) propane, 2,2-bis(4-hydroxy-3,5-dichlorophenyl)propane and 2,2bis(4-hydroxy-3,5-dimethyl)propane; N,N'-di-2-naphthyl-p-phenylenediamine; sodium 2,2'-methylenebis(4,6-di-tertbutylphenyl)-phosphate; ethyleneimine compounds such as 4,4'-bis(ethyleneiminecarbonylamino)diphenylmethane; and epoxy comounds such as 1,4-diglycidyloxybenzene and novolak resin.

In the protective layer, there may be added, if necessary, the following additives as well as the above described binders; such as calcium carbonate, zinc oxide which may be finely divided, aluminum oxide, titanium dioxide, silicon dioxide, aluminum hydroxide which may be coated by a silane or titanate coupling agent or stearic acid), barium sulfate, zinc sulfate, talc, kaolin, clay, calcined kaolin, colloidal silica, styrene microball, Nylon powder, polyethylene powder, urea-formaldehyde resin filler, raw starch particles and polyurea-polyurethane microcapsules. Among them, there are preferably used kaolin which is useful for increasing the barrier characteristic of the protective layer, and the surface-treated aluminum hydroxide and polyurea-polyurethane microcapsules which are useful for more improving the printability. In the polyurea-polyurethane microcapsules, ultraviolet ray absorber, fluorescent dye, releasing agent and the like may be comprised in addition to a solvent having a high boiling point such as diisopropylnaphthalene. The used amount of the additives is generally within the range of 5 to 300 parts by weight per 100 parts of the water-soluble polymer.

Further, to the coating composition for forming the protective layer, there may be added, if necessary, various additives such as lubricants, e.g., zinc stearate, calcium stearate, polyethylene wax, carnauba wax, paraffin wax and ester wax; surface active agents (dispersing agents, wetting agents), e. g., sodium dioctylsulfosuccinate; defoaming agents; water-soluble polyvalent metals and the like. Additionally, hardening agents such as glyoxal, boric acid, dialdehyde starch, epoxy compounds and the like may be used to more improve the water resistance.

A method for forming the recording layer or the protective layer is not particularly limited. Any known conventional coating methods may be used. For instance, the recording layer can be formed by applying a coating composition on a support by such as air-knife coating, pure blade coating, rod blade coating, short-dwell coating, curtain coating or die coating method, and then drying it. As the support, there may be used paper, plastic film, synthetic paper, non-woven fabric and the like. The amount of the coating composition is not particularly limited, but it is generally within the range of 1 to 10 g/m$^2$, preferably 2 to 6 g/m$^2$, on dry basis. The protective layer arbitrarily formed on the recording layer may be formed in the same manner as described above. The coating amount of the protective layer is generally within the range of 0.1 to 20 g/m$^2$, preferably 0.5 to 6 g/m$^2$, on dry basis.

Particularly, by using as a binder a water-soluble graft copolymer of a polymer comprising ethylenically unsaturated carboxylic acid unit and a silicone in the protective layer formed on the recording layer, a heat-sensitive recording material very superior in recording runnability can be obtained.

PREFERRED EMBODIMENTS OF THE INVENTION

The following examples serve to illustrate the invention in more detail although the invention is not limited to the examples. Unless otherwise indicated, parts and % signify parts by weight and % by weight, respectively.

I) First Embodiment:

Example I-1

(1) Preparation of Dispersion I-A:

The following composition was pulverized by a sand mill until an average particle size of 1 micron.

| | |
|---|---|
| 3-di(n-butyl)amino-6-methyl-7-phenylamino-fluorane | 10 parts |
| 1,2-di(3-methylphenoxy)ethane | 15 parts |
| methyl cellulose (5% aqueous solution) | 15 parts |
| water | 80 parts |

(2) Preparation of Dispersion I-B:

The following composition was pulverized by a sand mill until an average particle size of 2 microns.

| | |
|---|---|
| 4-hydroxy-4'-isopropoxydiphenylsulfone | 30 parts |

-continued

| | |
|---|---|
| methyl cellulose (5% aqueous solution) | 30 parts |
| water | 70 parts |

(3) Preparation of Recording Layer:

The following composition was mixed with stirring to make a coating composition.

| | |
|---|---|
| Dispersion I-A | 120 parts |
| Dispersion I-B | 130 parts |
| finely divided silica | 25 parts |
| precipitated calcium carbonate | 5 parts |
| sodium salt of water-soluble graft copolymer of polyacrylic acid and silicone in a weight ratio of 8:2 (25% aqueous solution) | 50 parts |
| zinc stearate (30% aqueous dispersion) | 20 parts |
| water | 55 parts |

The coating composition was coated on wood free paper of 50 g/m$^2$ in the weight of an amount of 5 g/m$^2$ on dry basis and dried to form a heat-sensitive recording layer on the paper. The product was super-calendered to obtain a heat-sensitive recording material.

Example I-2

A heat-sensitive recording material was prepared in the same manner as in Example I-1 except that 25% aqueous solution of an ammonium salt of water-soluble graft-copolymer of polymethacrylic acid and silicone in a weight ratio of 85:15 was used instead of 25% aqueous solution of the sodium salt of water-soluble graft copolymer of polyacrylic acid and silicone.

Example I-3

A heat-sensitive recording material was prepared in the same manner as in Example I-1 except that 20 parts of 25% aqueous solution of a sodium salt of water-soluble graft-copolymer of maleic anhydride/styrene (3/1) copolymer and silicone in a weight ratio of 8:2 and 25 parts of 10% aqueous solution of silicon-modified polyvinyl alcohol were used instead of 50 parts of 25% aqueous solution of the sodium salt of water-soluble graft copolymer of polyacrylic acid and silicone.

Comparative Example I-1

A heat-sensitive recording material was prepared in the same manner as in Example I-1 except that 25 parts of 50% aqueous emulsion of methylmethacrylate/silicone (8/2) copolymer was used instead of 50 parts of 25% aqueous solution of the sodium salt of water-soluble graft copolymer of polyacrylic acid and silicone.

Comparative Example I-2

A heat-sensitive recording material was prepared in the same manner as in Example I-1 except that 125 parts of 10% aqueous solution of an acetoacerylated polyvinyl alcohol (Z-210 manufactured Nippon Gohsei Kagaku Kogyo Kabushiki Kaisha) was used instead of 50 parts of 25% aqueous solution of the sodium salt of water-soluble graft copolymer of polyacrylic acid and silicone.

Comparative Example I-3

A heat-sensitive recording material was prepared in the same manner as in Example I-1 except that 42 parts of 30% aqueous dispersion of a soap-free and self-curable acrylic ester resin was used instead of 50 parts of 25% aqueous solution of the sodium salt of water-soluble graft copolymer of polyacrylic acid and silicone.

The properties of thus obtained six heat-sensitive recording materials were evaluated by the following tests. The results are shown in Table 1.

(1) Color density of recorded images

Each of thus obtained heat-sensitive recording materials was recorded by a simulator for heat-sensitive recording (TH-PDM manufactured by Ohkura Denki Kabushiki Kaisha) with a printing head energy of 0.3 mJ/dot. The color density of the recorded images was measured by Macbeth densitometer RD 914 manufactured by Macbeth Corporation.

(2) Printability

Each heat-sensitive recording material was printed by RI Printing Tester manufactured by Akira Seisakusho with use of 0.4 cc of an ink (tackiness value: 13) for wet rotary offset press, in which the recording material was passed through a water roll and then printed by an ink-mounted roll. The stability of the recording layer was evaluated by the following criteria.

◎: The recording layer was not peeled off.
O: The recording layer was scarcely peeled off.
Δ: The recording layer was somewhat peeled off.
x: The recording layer was remarkably peeled off.

(3) Water resistance

A drop of water was applied to the recording surface and the surface was rubbed by a finger ten times. The stability of the recording layer was evaluated by the following criteria.

O: The recording layer was scarcely peeled off.
Δ: The recording layer was somewhat peeled off.
x: The recording layer was remarkably peeled off.

(4) Recording runnability

The recording runnability was evaluated by the sound (sticking sound) generated when the heat-sensitive recording material was recorded by the above (1) method.

◎: The runnability was very good.
O: The runnability was good.
x: The runnability was bad.

TABLE 1

| No | Color density | Print-ability | Water resistance | Recording runnability |
|---|---|---|---|---|
| Examples | | | | |
| I-1 | 1.34 | ◎ | ○ | ◎ |
| I-2 | 1.32 | ◎ | ○ | ◎ |
| I-3 | 1.34 | ○ | ○ | ○ |
| Comparative Examples | | | | |
| I-1 | 1.33 | ○ | Δ | X |
| I-2 | 1.33 | X | X | ○ |
| I-3 | 1.30 | Δ | Δ | X |

II) Second Embodiment:

Example I-1

(1) Preparation of Dispersion II-A:

The following composition was pulverized by a sand mill until an average particle size of 2 microns.

| | |
|---|---|
| 3-di(n-butyl)amino-6-methyl-7-phenylamino-fluorane | 10 parts |
| methyl cellulose (5% aqueous solution) | 5 parts |
| water | 40 parts |

(2) Preparation of Dispersion II-B:

The following composition was pulverized by a sand mill until an average particle size of 2 microns.

| | |
|---|---|
| 4-hydroxy-4'-isopropoxydiphenylsulfone | 30 parts |
| methyl cellulose (5% aqueous solution) | 5 parts |
| water | 80 parts |

(3) Preparation of Dispersion II-C:

The following composition was pulverized by a sand mill until an average particle size of 2 microns.

| | |
|---|---|
| 1,2-di(3-methylphenoxy)ethane | 20 parts |
| methyl cellulose (5% aqueous solution) | 5 parts |
| water | 55 parts |

(4) Preparation of heat-sensitive recording layer:

The following composition was mixed with stirring to make a coating composition.

| | |
|---|---|
| Dispersion II-A | 55 parts |
| Dispersion II-B | 115 parts |
| Dispersion II-C | 80 parts |
| polyvinyl alcohol (10% aqueous solution) | 80 parts |
| calcium carbonate | 35 parts |

The coating composition was coated on wood free paper of 70 g/m$^2$ in the weight of an amount of 6 g/m$^2$ on dry basis and dried to form a heat-sensitive recording layer on the paper.

(5) Formation of protective layer:

The following composition was mixed with stirring to make a coating composition.

| | |
|---|---|
| kaolin (UW-90 manufactured by EMC Co.) | 65 parts |
| acetoacetylated polyvinyl alcohol (10% aqueous solution) | 250 parts |
| zinc stearate (30% aqueous dispersion) | 6 parts |
| sodium salt of water-soluble graft copolymer of polyacrylic acid and silicone in a weight ratio of 8:2 (25% aqueous solution) | 40 parts |
| water | 65 parts |

The coating composition was coated on the above heat-sensitive recording layer in an amount of 6 g/m$^2$ on dry basis, dried and super-calendered to obtain a heat-sensitive recording material.

Example II-2

A heat-sensitive recording material was prepared in the same manner as in Example I-1 except that 20 parts of 25% aqueous solution of an ammonium salt of water-soluble graft-copolymer of polymethacrylic acid and silicone in a weight ratio of 85:15 was used instead of 20 parts of 25% aqueous solution of the sodium salt of water-soluble graft copolymer of polyacrylic acid and silicone to form the protective layer.

Example II-3

A heat-sensitive recording material was prepared in the same manner as in Example II-1 except that 20 parts of 25% aqueous solution of a sodium salt of water-soluble graft-copolymer of maleic anhydride/styrene (3/1) copolymer and silicone in a weight ratio of 8:2 and 25 parts of 10% aqueous solution of silicon-modified polyvinyl alcohol were used instead of 20 parts of 25% aqueous solution of the sodium salt of water-soluble graft copolymer of polyacrylic acid and silicone.

Example II-4

(1) Preparation of Dispersion II-D:

220 Parts of 12% aqueous solution of acetoacetylated partially saponified polyvinyl alcohol (Gohsefimer Z-210 manufactured by Nippon Gohsei Kagaku Kogyo Kabushiki Kaisha) was added to an agitating vessel equiped with a heater as an aqueous medium for producing capsules. The solution obtained by mixing the following components at 40° C.,

| | |
|---|---|
| diisopropylnaphthalene | 77 parts |
| hexamethylenediisocyanate trimer (isocyanurate type)[Takenate D-170HN manufactured by Takeda Seiyaku Kogyo Kabushiki Kaisha] | 33 parts |

was added to the above aqueous medium and the mixture was emulsified with TK homomixer (Model HV-M manufactured Tokushu Kika Kogyo Kabushiki Kaisha) under cooling until an average particle size of 1.7 microns.

To thus obtained emulsion 175 parts of water was added and reacted at 90 ° C. for 5 hours with stirring to prepare a dispersion of microcapsules having a polyurethane-polyurea resinous wall.

(2) Formation of protective layer:

The following composition was mixed with stirring to make a coating composition.

| | |
|---|---|
| Dispersion II-D | 150 parts |
| kaolin | 33 parts |
| acetoacetylated polyvinyl alcohol (10% aqueous solution) | 170 parts |
| zinc stearate (30% aqueous dispersion) | 6 parts |
| sodium salt of water-soluble graft copolymer of polyacrylic acid and silicone in a weight ratio of 8:2 (25% aqueous solution) | 40 parts |
| water | 65 parts |

The coating composition was coated on a heat-sensitive recording layer obtained in the same manner as in Example II-1 in an amount of 6 g/m$^2$ on dry basis, dried and super-calendered to obtain a heat-sensitive recording material.

Example II-5

A heat-sensitive recording material was obtained in the same manner as in Example II-4 except that 77 parts of 2-(2'-hydroxy-3'-dodecyl-5'-methylphenyl) benzotriazole was used instead of 77 parts of diisopropylnaphthalene to prepare Dispersion II-D.

The heat-sensitive recording material was particularly superior in light resistance of recorded images.

Example II-6

A heat-sensitive recording material was obtained in the same manner as in Example II-1 except that 65 parts of aluminum hydroxide (Haiji-light H-42 STE (silane-treated aluminum hydroxide) manufactured by Shouwa Denko Kabushiki Kaisha) was used instead of 65 parts of kaolin to form the protective layer.

Comparative Example II-1

A heat-sensitive recording material was prepared in the same manner as in Example II-1 except that 40 parts of 25% aqueous solution of the sodium salt of water-soluble graft copolymer of polyacrylic acid and silicone was not used to form the protective layer.

Comparative Example II-2

A heat-sensitive recording material was prepared in the same manner as in Example II-1 except that 20 parts of 25% aqueous solution of a soap-free and self-curable acrylic ester resin was used instead of 40 parts of 25% aqueous solution of the sodium salt of water-soluble graft copolymer of polyacrylic acid and silicone.

Comparative Example II-3

A heat-sensitive recording material was prepared in the same manner as in Example II-1 except that 20 parts of 25% silicone emulsion was used instead of 20 parts of 25% aqueous solution of the sodium salt of water-soluble graft copolymer of polyacrylic acid and silicone to form the protective layer.

II) Third Embodiment:

Example III-1

(1) Preparation of Dispersion III-A:

The following composition was pulverized by a sand mill until an average particle size of 2 microns.

| | |
|---|---|
| 3-di(n-butyl)amino-6-methyl-7-phenylamino-fluorane | 10 parts |
| 1,2-di(3-methylphenoxy)ethane | 15 parts |
| methyl cellulose (5% aqueous solution) | 15 parts |
| water | 80 parts |

(2) Preparation of Dispersion III-B:

The following composition was pulverized by a sand mill until an average particle size of 2 microns.

| | |
|---|---|
| 4-hydroxy-4'-isopropoxydiphenylsulfone | 30 parts |
| methyl cellulose (5% aqueous solution) | 30 parts |
| water | 70 parts |

(3) Preparation of heat-sensitive recording layer:

The following composition was mixed with stirring to make a coating composition.

| | |
|---|---|
| Dispersion III-A | 120 parts |
| Dispersion III-B | 130 parts |
| finely divided anhydrous silica | 10 parts |
| precipitated calcium carbonate | 5 parts |
| sodium salt of water-soluble graft copolymer of polyacrylic acid and silicone in a weight ratio of 8:2 (25% aqueous solution) | 50 parts |
| zinc stearate (30% aqueous dispersion) | 10 parts |
| water | 20 parts |

The coating composition was coated on wood free paper of 25 g/m$^2$ in the weight of an amount of 4 g/m$^2$ on dry basis and dried to form a heat-sensitive recording layer.

(4) Formation of protective layer:

The following composition was mixed with stirring to make a coating composition.

| | |
|---|---|
| finely divided anhydrous silica | 20 parts |
| precipitated calcium carbonate | 5 parts |
| sodium salt of water-soluble graft copolymer of polyacrylic acid and silicone in a weight ratio of 8:2 (25% aqueous solution) | 50 parts |
| zinc stearate (30% aqueous dispersion) | 10 parts |
| water | 60 parts |

The coating composition was coated on the above heat-sensitive recording layer in an amount of 5 g/m$^2$ on dry basis, dried and super-calendered to obtain a heat-sensitive recording material comprising a specific graft copolymer in both of the recording layer and the protective layer.

Example III-2

A heat-sensitive recording material was prepared in the same manner as in Example III-1 except that 50 parts of 25% aqueous solution of an ammonium salt of water-soluble graft copolymer of polymethacrylic acid and silicone in a weight ratio of 85:15 was used instead of 50 parts of 25% aqueous solution of the sodium salt of water-soluble graft copolymer of polyacrylic acid and silicone to prepare the coating composition for heat-sensitive recording layer.

Example III-3

A heat-sensitive recording material was prepared in the same manner as in Example III-1 except that 20 parts of 25% aqueous solution of a sodium salt of water-soluble graft-copolymer of maleic anhydride/styrene (3/1) copolymer and silicone in a weight ratio of 8:2 and 25 parts of 10% aqueous solution of silicon-modified polyvinyl alcohol were used instead of 50 parts of 25% aqueous solution of the sodium salt of water-soluble graft copolymer of polyacrylic acid and silicone to prepare the coating composition for heat-sensitive recording layer.

Example III-4

A heat-sensitive recording material was prepared in the same manner as in Example III-1 except that 90 parts of 29% aqueous solution of an ammonium salt of water-soluble graft copolymer of polymethacrylic acid and silicone in a weight ratio of 89:15 was used instead of 90 parts of 29% aqueous solution of the sodium salt of water-soluble graft copolymer of polyacrylic acid and silicone to prepare the coating composition for protective layer.

The properties of thus obtained heat-sensitive recording materials were evaluated by the following tests. The results are shown in Table 2.

(1) Offset-printability:

Each of thus obtained heat-sensitive recording materials was passed through a water roll of RI Printing Tester manufactured by Akira Seisakusho and then printed by a roll mounted with 0.4 cc of a black ink for rotary offset press (web zett manufactured by Dainippon Ink and Chemicals Inc.). The color density of the printed images was measured by Macbeth densitometer RD 914 manufactured by Macbeth Corporation. The higher value indicates that it is superior in offset-printability.

(2) Color density of recorded images

Each of thus obtained heat-sensitive recording materials was recorded by a simulator for heat-sensitive recording (TH-PDM manufactured Ohkura Denki Kabushiki Kaisha) with a recording head energy of 0.2 mJ/dot. The color density of the recorded images was measured by Macbeth densitometer RD 914 manufactured by Macbeth Corporation.

(3) Image-retainability:

A wrapping film (KMA-W manufactured by Mitsui Toatsu Chemicals, Inc.) was wrapped threefold around a polycarbonate pipe having a diameter Of 40 mm. A heat-sensitive recording material after developing color images by the above method (2) was put on it in the manner color images are exposed outward and further the same film was wrapped three fold around the heat-sensitive recording material. The resultant material was stood at 40 ° C. for 24 hours and then the color density was measured to evaluate image-retainability. The higher value indicates that it is superior in image-retainability.

(4) Printability

Each heat-sensitive recording material was printed by RI Printing Tester manufactured by Akira Seisakusho with use of 0.4 cc of an ink (tackiness value: 13) for wet rotary offset press, in which the recording material was passed through a water roll and then printed by a ink-mounted roll. The stability of the recording layer was evaluated .by the following criteria.

◎: The recording layer was not peeled off.
O: The recording layer was scarcely peeled off.
Δ: The recording layer was somewhat peeled off.
x: The recording layer was remarkably peeled off.

(5) Water resistance

A drop of water was applied to the recording surface and the surface was rubbed by a finger twenty times. The stability of the recording layer was evaluated by the following criteria.

O: The recording layer was scarcely peeled off.
Δ: The recording layer was somewhat peeled off.
x: The recording layer was remarkably peeled off.

(6) Finger-print Resistance

The recorded color images was strongly pressed by an oily finger. After three days, the color density of the pressed color images was compared with that of the non-pressed color images by a naked eye.

O: The color density was not substantially changed.
Δ: The color density was somewhat changed.
x: The color density was remarkably changed.

(7) Recording runnability

The recording runnability was evaluated by the sound (sticking sound) generated when the heat-sensitive recording material was printed by the above (2) method with a recording head energy of 0.5 mJ/dot.

◎: The runnability was very good.
O: The runnability was good.
x: The runnability was bad.

(8) Smudges adhered on thermal head The amount of smudges adhered on thermal head after printing 100 m in the same manner as in the above method (2) was evaluated.

◎: Smudges were not substantially adhered.
O: Smudges were scarcely adhered.
x: Smudges were remarkably adhered.

TABLE 2

| | Test No. | | | | | | | |
|---|---|---|---|---|---|---|---|---|
| | 1 | 2 | 3 | 4 | 5 | 6 | 7 | 8 |
| Examples | | | | | | | | |
| II-1 | 1.33 | 1.35 | 1.26 | O | O | O | ◎ | O |
| II-2 | 1.31 | 1.35 | 1.25 | O | O | O | ◎ | O |
| II-3 | 1.25 | 1.35 | 1.24 | O | O | O | ◎ | O |
| II-4 | 1.47 | 1.40 | 1.35 | ◎ | O | O | ◎ | O |
| II-5 | 1.45 | 1.39 | 1.36 | ◎ | O | O | ◎ | O |
| II-6 | 1.40 | 1.30 | 1.22 | O | O | O | ◎ | O |
| Comparative Examples | | | | | | | | |
| II-1 | 0.56 | 1.25 | 1.20 | X | X | O | X | O |
| II-2 | 0.56 | 1.35 | 1.02 | Δ | Δ | O | O | O |
| II-3 | 1.20 | 1.15 | 0.76 | X | X | O | ◎ | O |
| Examples | | | | | | | | |
| II-1 | 1.40 | 1.36 | 1.22 | ◎ | O | O | ◎ | O |
| II-2 | 1.39 | 1.33 | 1.23 | ◎ | O | O | ◎ | O |
| II-3 | 1.35 | 1.32 | 1.20 | O | O | O | ◎ | O |
| II-4 | 1.37 | 1.31 | 1.21 | ◎ | O | O | ◎ | O |

As shown in Tables 1 and 2, the heat-sensitive recording materials according to the present invention were superior in each of water resistance, printability and recording runnability.

What is claimed is:

1. A heat-sensitive recording material having on a base sheet a heat-sensitive recording layer which comprises a colorless or pale colored basic chromogenic material and a color developer, the heat-sensitive recording layer further comprising a water-soluble graft copolymer comprising at least one ethylenically unsaturated carboxylic acid unit and silicone.

2. A heat-sensitive recording material according to claim 1, wherein the water-soluble graft copolymer is comprised in the recording layer in an amount of 1 to 15% by weight based on the total solid amount of the recording layer.

3. A heat-sensitive recording material having on a base sheet (1) a heat-sensitive recording layer which comprises a colorless or pale colored basic chromogenic material and a color developer, and (2) a protective layer formed on the recording layer, the protective layer comprising a water-soluble graft copolymer comprising at least one ethylenically unsaturated carboxylic acid unit and silicone.

4. A heat-sensitive recording material according to claim 3, wherein the protective layer further comprises a pigment.

5. A heat-sensitive recording material according to claim 3, wherein the water-soluble graft copolymer is comprised in the protective layer in an amount of 0.1 to 50% by weight based on the total amount of the protective layer.

6. A heat-sensitive recording material according to claim 1 and 3, wherein the silicone comprised in the water-soluble graft copolymer is in an amount of 5 to 50% by weight based on the total solid amount of the water-soluble graft copolymer.

7. A heat-sensitive recording material according to claim 3, wherein the protective layer further comprises at least one selected from the group consisting of acetoacetyl-modified polyvinyl alcohol, carboxylated polyvinyl alcohol and silicon-modified polyvinyl alcohol.

8. A heat-sensitive recording material as defined in claim 3, wherein the recording layer also comprises a water-soluble graft copolymer comprising at least one ethylenically unsaturated carboxylic acid unit and silicone.

9. A heat-sensitive recording material according to claim 8, wherein the water-soluble graft copolymer of the recording layer is in an amount of 1 to 15% by weight based on the total solid amount of the recording layer.

10. A heat-sensitive recording material according to claim 3, wherein the silicone of the water-soluble graft copolymer is in an amount of 5 to 50% by weight based on the total solid amount of the water-soluble graft copolymer.

* * * * *